US010987954B2

(12) United States Patent
Laws et al.

(10) Patent No.: US 10,987,954 B2
(45) Date of Patent: Apr. 27, 2021

(54) LOAD STOPS

(71) Applicant: Hewlett-Packard Development Company, L.P., Houston, TX (US)

(72) Inventors: Alexander D Laws, Vancouver, WA (US); Benjamin M Coder, Vancouver, WA (US); Robert L Winburne, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 323 days.

(21) Appl. No.: 16/064,251

(22) PCT Filed: Apr. 18, 2016

(86) PCT No.: PCT/US2016/028092
§ 371 (c)(1),
(2) Date: Jun. 20, 2018

(87) PCT Pub. No.: WO2017/184108
PCT Pub. Date: Oct. 26, 2017

(65) Prior Publication Data

US 2019/0001711 A1 Jan. 3, 2019

(51) Int. Cl.
*B41J 11/24* (2006.01)
*B41J 11/00* (2006.01)
(Continued)

(52) U.S. Cl.
CPC ..... *B41J 11/24* (2013.01); *B41J 11/006* (2013.01); *B65H 3/0661* (2013.01);
(Continued)

(58) Field of Classification Search
CPC ..... B41J 11/006; B41J 11/24; B65H 3/34; B65H 3/0661; B65H 3/0669; B65H 3/565;
(Continued)

(56) References Cited

U.S. PATENT DOCUMENTS 4,744,687 A 5/1988 Nukaya et al.
5,397,191 A 3/1995 Murakami et al.
(Continued)

FOREIGN PATENT DOCUMENTS

JP 05162869 6/1993
JP 06298385 10/1994
(Continued)

*Primary Examiner* — Matthew G Marini
*Assistant Examiner* — Marissa Ferguson-Samreth
(74) *Attorney, Agent, or Firm* — HP Inc. Patent Department

(57) ABSTRACT

In an example, a load stop may comprise a stop paddle, a paddle link, a swingarm engaged with a motive element, and a cam gear to engage the swingarm with the paddle link. The paddle link may move the stop paddle from a locked position, to a gathering position, and to a stowed position. The swingarm may transfer the motion of the motive element to the cam gear such that the cam gear is to move in a first direction, the cam gear to drive the paddle link to move the stop paddle from the locked position, to the gathering position, and to the stowed position when the motive element moves in a first drive direction, and the swingarm moves the cam gear in the first direction.

14 Claims, 11 Drawing Sheets

(51) Int. Cl.
*B65H 3/34* (2006.01)
*B65H 3/06* (2006.01)
*B65H 3/56* (2006.01)

(52) U.S. Cl.
CPC ..... *B65H 3/0669* (2013.01); *B65H 3/34* (2013.01); *B65H 3/565* (2013.01); *B65H 2402/46* (2013.01); *B65H 2403/42* (2013.01); *B65H 2403/421* (2013.01); *B65H 2403/53* (2013.01)

(58) Field of Classification Search
CPC ..... B65H 2402/46; B65H 2403/42; B65H 2403/421; B65H 2403/53
See application file for complete search history.

(56) References Cited

U.S. PATENT DOCUMENTS

| | | | | |
|---|---|---|---|---|
| 6,079,887 | A | 6/2000 | Koyabu et al. | |
| 6,666,446 | B2 | 12/2003 | Gaarder et al. | |
| 7,926,803 | B2 * | 4/2011 | Sherman | B65H 3/0684 271/117 |
| 8,538,307 | B2 | 9/2013 | Hisano | |
| 8,771,159 | B2 | 7/2014 | Imazu et al. | |
| 8,919,761 | B2 | 12/2014 | Morinaga et al. | |
| 9,033,332 | B2 | 5/2015 | Sato et al. | |
| 10,118,778 | B2 * | 11/2018 | Kawashima | B65H 1/08 |
| 2005/0035524 | A1 * | 2/2005 | Fukumura | B65H 3/0684 271/4.1 |
| 2012/0049435 | A1 * | 3/2012 | Stiehler | B65H 3/56 271/10.13 |
| 2014/0054846 | A1 * | 2/2014 | Jariabka | B65H 5/16 271/109 |
| 2014/0339760 | A1 | 11/2014 | Winburne et al. | |
| 2018/0297799 | A1 * | 10/2018 | Laws | B41J 29/00 |

FOREIGN PATENT DOCUMENTS

| | | | |
|---|---|---|---|
| JP | 07149013 | 6/1995 | |
| WO | 2017184162 | * 10/2017 | H04N 1/04 |

* cited by examiner

LOAD STOPS

BACKGROUND

Imaging systems may print, scan, copy, or perform other actions with media. The imaging systems may scan the media for markings or patterns, deposit printing fluid, such as ink, or another printing substance, such as three-dimensional printing powder, on the media, or on a target for the media, and/or may produce duplicates of the media, including markings or patterns thereon, in addition to other functions. Further, imaging systems may include feeding or picking systems to load the media and deliver or drive the media through the imaging system for performing operations on or with the media. Prior to being picked by the picking system, media may be loaded into an input area or tray of the imaging device, for use within the imaging device.

DETAILED DESCRIPTION

Figure 1A:
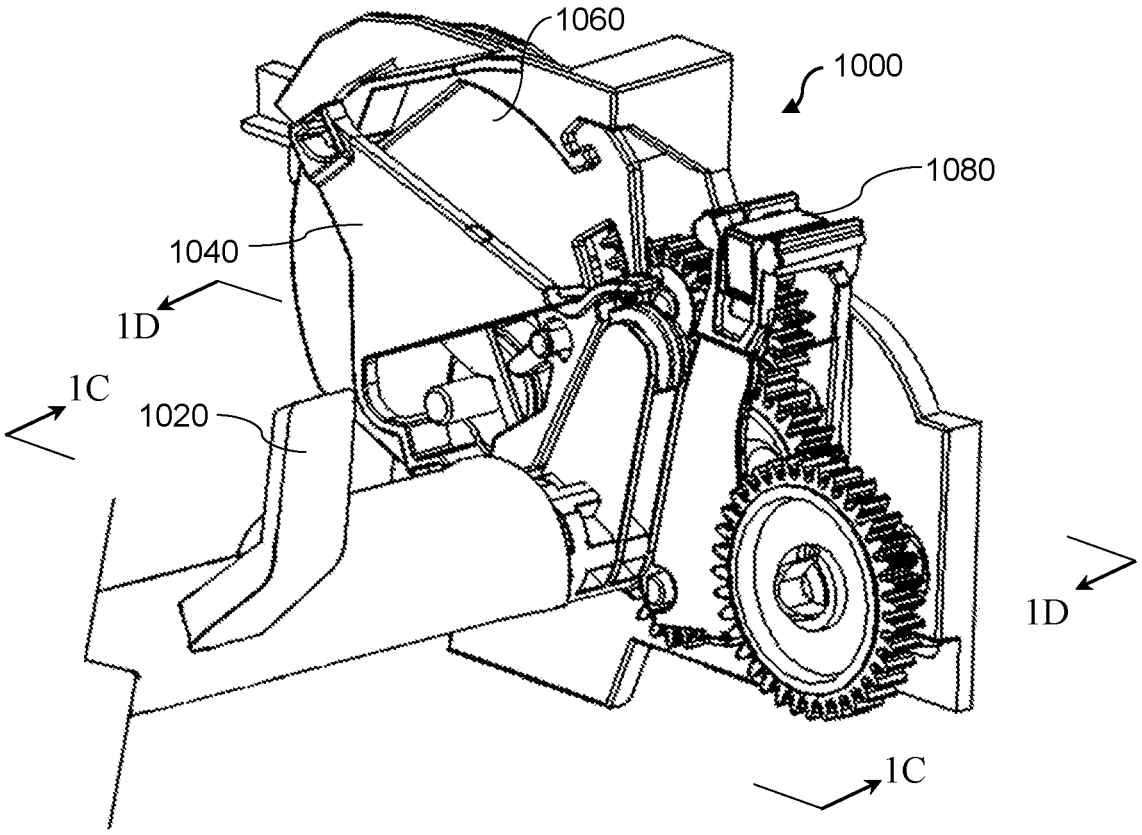
FIG. 1A is a perspective view of an example load stop.

Imaging systems may include scanning systems, copying systems, printing or plotting systems, or other systems that perform actions or operations on or with media, sometimes referred to as print media. Imaging systems may deposit printing fluid, such as ink, or another printing substance, on media. Further, imaging systems may include feeding or picking systems to load the media and deliver or drive the media through a media path of the imaging system for performing operations on or with the media. Prior to being picked by the picking system, media, or a stack or ream thereof, may be loaded into an input area or input tray of the imaging device, for use within the imaging device.

In some situations, the media may be loaded too far into the input area, which may cause a jam or malfunction of internal components of the imaging device. Such a malfunction may prevent the imaging device from properly picking media from the input area and driving the media through the media path. Additionally, the media, in some situations, may be loaded into the input area in a disorderly fashion, causing inconsistencies in the orientation or disposition of the media in the input area. Such inconsistencies or incorrect orientation of the media may also cause a malfunction, thereby preventing the proper picking and driving of the media through the media path.

In further situations, it may be desirable to provide an imaging device that may prevent media from being loaded too far into the media path or input area. Further, it may be desirable for the imaging device to include a way to gather or organize the media within the input area or input tray such that the media is disposed consistently and properly within the input area so that the media may be properly picked and driven through the media path. In yet further situations, it may be desirable to provide a system within the imaging device that may both stop the media from being loaded too far into the input area, and also may then gather, organize, or properly dispose the media within the input area for proper feeding. Additionally, it may be desirable to then stow the system out of the way of the media path, such that the media may be picked and driven through the media path. In yet further situations, it may be desirable for the system to stop media from being loaded too far into the input area again after the media already disposed within the input area has been gathered or organized.

Implementations of the present disclosure provide a load stop that may be used in an imaging device. Implementations of the load stop provide a system to prevent media from being loaded too far into an input area of an imaging device, and to gather or organize the media within the input area for the proper picking and feeding of the media. Implementations of the present disclosure may provide a system that, after the media is gathered or organized, may stow itself out of the media path, so that media may be picked and delivered, or may return to a state wherein the system may continue to prevent media from being loaded too far into the input area.

Figure 1B:
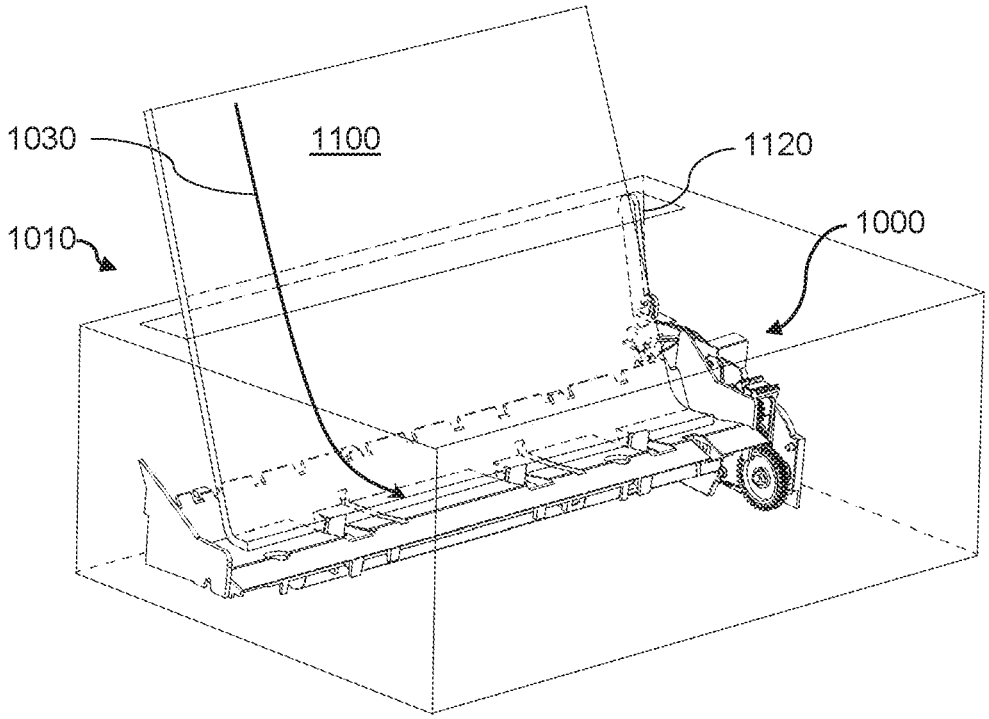
FIG. 1B is a perspective view of an example imaging device including an example load stop.

Referring now to FIG. 1A, a perspective view of an example load stop 1000 is illustrated. In some implementations, the example load stop 1000 may include a stop paddle 1020, a paddle link 1040, a cam gear 1060, and a swingarm 1080. Also referring to FIG. 1B, a perspective view of an example imaging device 1010 including the example load stop 1000 is illustrated. In some implementations, the example imaging device may be a printer, scanner, copier, or other type of imaging device to perform an action with or on media 1100, sometimes referred to as print media. In some implementations, the media 1100 may be loaded into an input tray or input area 1120 by a user or another system. After being loaded into the input area 1120, the media may be picked by the imaging device and may be fed, driven, or delivered through a media path so an operation may be performed with or on the media 1100. In some implementations, the stop paddle 1020 of the example load stop 1000 may be disposed in or near the input area 1120 such that, when disposed in a locked position, and upon the media 1100 being loaded a sufficient or appropriate distance into the input area 1120, the stop paddle 1020 may stop the media 1100 and may prevent the media 1100 from being loaded too far into the input area or media path of the imaging device 1010. In some implementations, the load stop 1000 may include multiple stop paddles 1020, as illustrated in FIG. 1B. In further implementations, the stop paddles 1020 may be disposed on a paddle shaft, the paddle shaft to move the stop paddles 1020 in unison. The media 1100 may be loaded into the input area 1120 and rest against a separator wall 1140, which each stop paddle 1020 may protrude through when in the locked position, in some implementations. Such a loading action may be represented by directional arrow 1030, in some implementations. In further implementations, each stop paddle 1020 may be switchable from the locked position, to a gathering position, and then to a stowed position. The stop paddle 1020 may then be movable from the stowed position back to the locked position. In yet further implementations, the stop paddle 1020 may be movable from the gathering position to either of the stowed position, or back to the locked position.

Figure 1C:
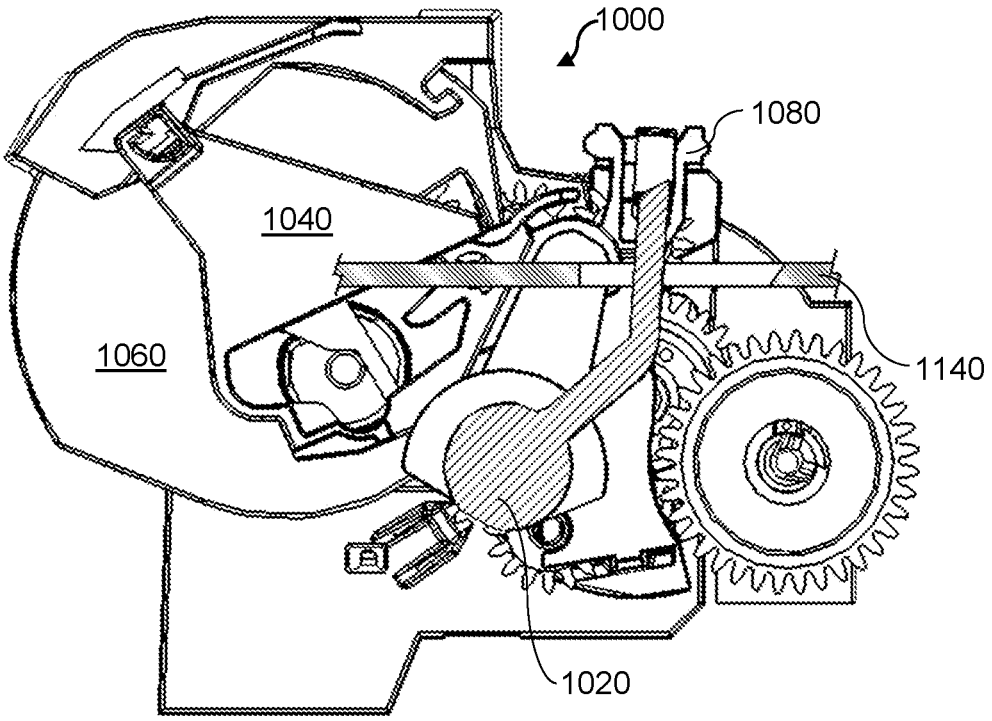
FIG. 1C is a side view of an example load stop.
Figure 1D:
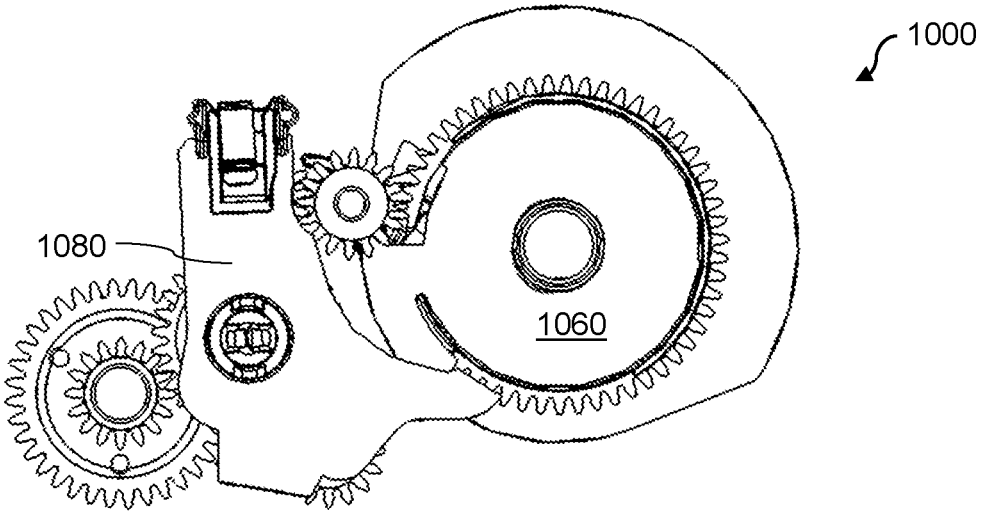
FIG. 1D is a side view of an example load stop.

Referring additionally to FIGS. 1C-D, an inside side view and an outside side view, respectively, of the example load stop 1000 are illustrated, as taken from respective view lines of FIG. 1A. FIGS. 1A-D illustrate the example load stop 1000 having the stop paddle 1020 in the locked position, wherein the stop paddle 1020 may stop media from moving forward in the input area. In order to do so, the stop paddle 1020 may reversibly extend or protrude through the separator wall 1140 when in the locked position. Additionally, when the stop paddle 1020 is in the locked position, the paddle link 1040, in some implementations, may latch on to a body of the load stop 1000, or another component thereof, such that the paddle link 1040 may hold the stop paddle 1020 in the locked position, and prevent the stop paddle 1020 from being forced or pushed out of the locked position.

Figure 2A:
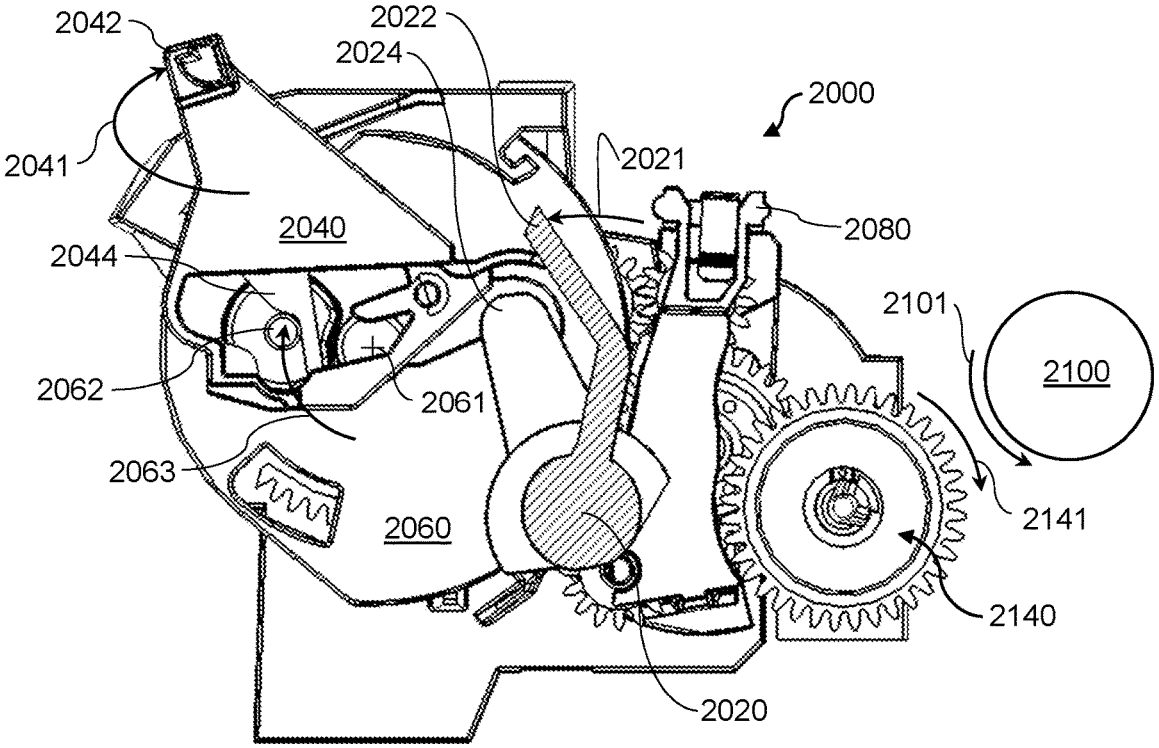
FIG. 2A is a side view of an example load stop.

Referring now to FIG. 2A, an inside side view of an example load stop 2000 is illustrated. Example load stop 2000 may be similar to example load stop 1000. Further, the similarly named elements of example load stop 2000 may be similar in function and/or structure to the elements of example load stop 1000, as they are described above. The example load stop 2000 may include a stop paddle 2020, a paddle link 2040, a cam gear 2060, and a swingarm 2080. FIG. 2A illustrates the load stop 2000 as completing a transition of the stop paddle 2020 from a locked position (similar to as illustrated in FIG. 1C) to a gathering position. In some implementations, the gathering position might be a position or movement wherein the stop paddle 2020 is to rotate towards media disposed within an input tray or input area of an imaging device, and gather or compress the media in order to organize the media for picking and delivery through a media path of the imaging device. In some implementations, during a transition from the locked position to the gathering position, the stop paddle 2020 may compress the media into a stack or ream of media that is ready for picking.

In some implementations, the stop paddle 2020 may be transitioned to the gathering position by a motive element 2100. In some implementations, the motive element 2100 may be a motor, a component of a transmission, a drive or feed shaft, or another component that may generate or transmit motion and/or torque to the load stop 2000. In some implementations, the paddle link 2040, the cam gear 2060, and the swingarm 2080 may operate in conjunction to transmit motion and/or torque from the motive element 2100 to the stop paddle 2020, in order to change the position of the stop paddle 2020. More specifically, in one example, the motive element may drive or be driven in a first drive direction 2100. The motive element 2100 may, in turn, drive a transmission 2140, or a component thereof, in a complementary first drive direction 2141. In some implementations, the transmission 2140 may be a wheel, or a series of wheels, gears, cogs, or other drive components to transmit the motion of the motive element 2100 to the cam gear 2060. In further implementations, the swingarm 2080 may be considered as being a part of the transmission 2140, or, alternatively, the swingarm 2080 may be considered as being a separate component that engages with the motive element 2100, through the transmission 2140. In further implementations, the motive element 2100 may be engaged directly with the swingarm 2080. It should be noted that, although the transmission 2140, the swingarm 2080, the cam gear 2060, and other components of the load stop 2000 are illustrated as gears, and engaging with each other through the use of meshing teeth, other engagement methods may be employed. Such other engagement methods may include friction surfaces, belt or chain drives, or other components capable of transmitting motion.

Figure 2B:
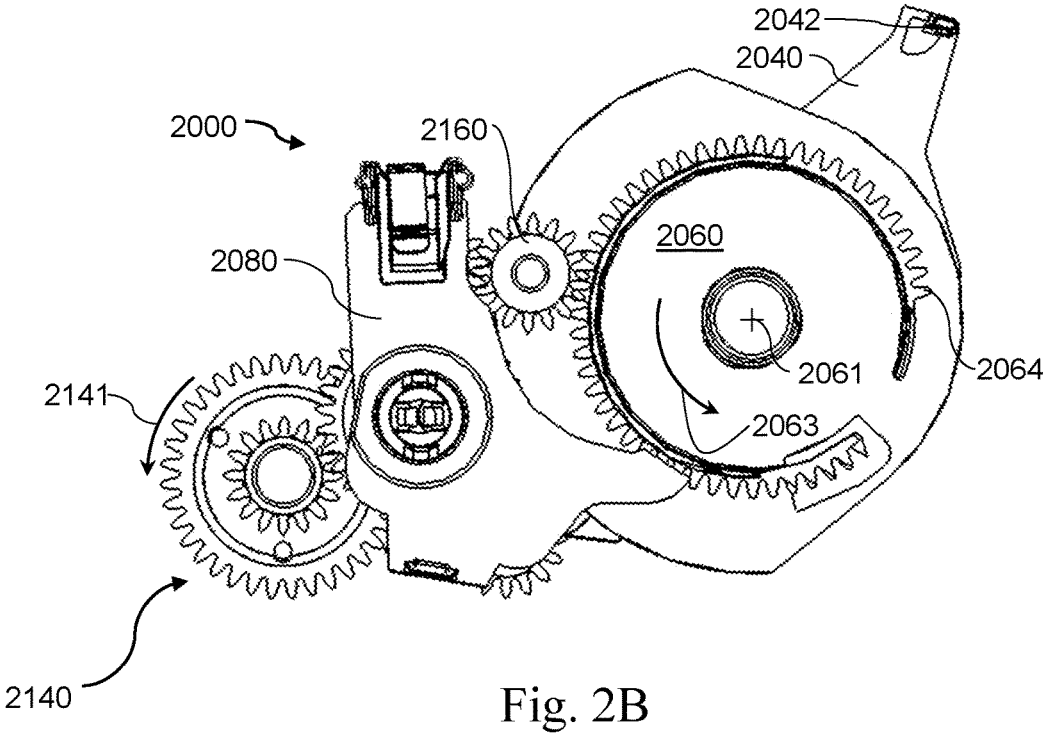
FIG. 2B is a side view of an example load stop.

Referring additionally to FIG. 2B, an outside side view of the example load stop 2000 is illustrated. The swingarm 2080 may be a component capable of transmitting motion and/or torque from the motive element 2100, or the transmission 2140 in some implementations, to the cam gear 2060. The swingarm 2080 may include one or several drive wheels, gears, or other transmission components to transmit motion to the cam gear 2060. The motive element 2100 may drive the transmission 2140 in the first drive direction 2141, and the swingarm 2080 may transmit that motion to the cam gear 2060 such that the cam gear 2060 is driven in a first direction 2063, as illustrated in FIGS. 2A-2B. The swingarm 2080 may further be positionable in, or switchable between, a first position and a second position in order to drive the cam gear 2060. FIG. 2B illustrates the swingarm 2080 is being disposed in the first position.

The cam gear 2060 may be a component capable of being driven or rotated in the first direction 2063, as well as a second direction, which may be opposite to the first direction 2063. In some implementations, the cam gear 2060 may be rotated about a center of rotation 2061. In further implementations, the cam gear 2060 may include a ring gear 2064 to engage with the swingarm 2080 such that the swingarm 2080 transmits motion, originating with the motive element, to the cam gear to drive the cam gear 2060 in the first direction 2063. In some implementations, the ring gear 2064 may be an array of teeth. In some implementations, the swingarm 2080 may engage with an idler wheel 2160, which may engage with the ring gear 2064 in order to drive the cam gear 2060 in the first direction 2063. In some implementations, the idler wheel 2160 may be oriented such that the swingarm 2080 engages with the idler wheel 2160 in the second position, and the swingarm 2080 engages with the ring gear 2064 directly when in the first position. The cam gear 2060 may also include a drive post 2062, in some implementations. The drive post 2062 may be a post or other protrusion extending out from the cam gear 2060 in order to engage with the paddle link 2040. The drive post 2062 may engage with a drive shoulder 2044 of the paddle link 2040. The drive shoulder 2044 may be rigidly connected to the paddle link 2040 such that the drive post 2062 may move the paddle link 2040 through the drive shoulder 2044 when the cam gear 2060 is driven in the first or second directions.

The paddle link 2040 may be a rigid or semi-rigid linkage, arm, or other component that may link the stop paddle 2020 to the cam gear 2060 in order to change the position of the stop paddle 2020. The paddle link 2040 may engage the stop paddle 2020 with the cam gear 2060 such that the stop paddle 2020 may transition or move from the locked position to the gathering position and to the stowed position when the cam gear 2060 is moved or rotated in the first direction 2063. The paddle link 2040 may engage with the stop paddle 2020, or a paddle shaft including the stop paddle 2020, through an engagement arm 2024, in some implementations. The paddle link 2040 may move the engagement arm 2024, which may move the stop paddle 2020, and a distal end 2022 thereof, along an example direction 2021 in order to transition the stop paddle 2020 to the gathering position. The paddle link 2040 may, in some implementations, include a lock latch 2042. The lock latch 2042 may include a tab, post, or other protrusion that may engage with a complementary locking ledge, shelf, or other locking feature 2260 of the load stop 2000 when the stop paddle 2020 is disposed in the locked position. Such an engagement may prevent the stop paddle 2020 from being forced out of the locked position, towards a stowed position, in some implementations. During the transition from the locked position to the gathering position, the paddle link 2040 may move or rotate in such a manner so as to disengage the lock latch 2042 from the complementary locking feature 2260. Such a movement of the paddle link 2040, and thus the lock latch 2042 thereof, may be similar to a movement represented by directional arrow 2041, in some implementations. In other implementations, the paddle link 2040 may move along a different path in order to disengage the lock latch 2042 during the transition of the stop paddle 2020 to the gathering position.

Figure 2C:
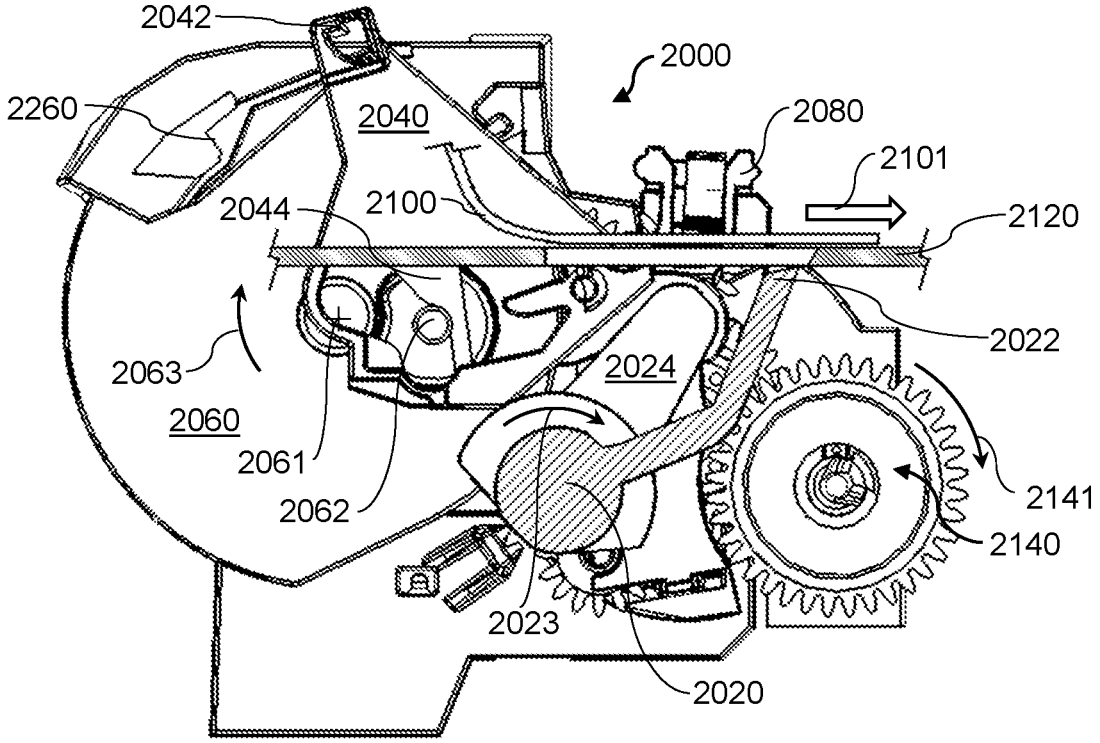
FIG. 2C is a front view of an example imaging device including an example cutting module.

Referring now to FIG. 2C, an inside side view of the example load stop 2000 is illustrated wherein the stop paddle 2020 has been moved or transitioned from the gathering position to the stowed position. When the stop paddle 2020 is disposed in the stowed position, the stop paddle 2020, or a distal end 2022 thereof, may no longer extend or protrude through a separator wall 2120. Therefore, the stop paddle 2020 may no longer prevent media 2100 from being inserted too far into the input area of the imaging device. In other words, when media 2100 is being loaded into the input area of the imaging device, the stop paddle 2020 may stop the media 2100 from being pushed in too far into the input area, thereby preventing possible malfunction of the imaging device. Once the media is loaded, the stop paddle 2020 may then transition to the gathering position in order to organize the media 2100 and ensure the media 2100 is disposed sufficiently for picking of the media 2100. After gathering the media, the stop paddle 2020 may then be transitioned to the stowed position (as illustrated in FIG. 2C) such that media may be picked from the input area and delivered through a media path of the imaging device, as represented by arrow 2101. In order to transition the stop paddle 2020 from the gathering position shown in FIG. 2A to the stowed position shown in FIG. 2C, the cam gear 2060 may continue to be driven in the first direction 2063. The drive post 2062 may then move the paddle link 2040, through the drive shoulder 2044 thereof, such that the paddle link 2040 moves the stop paddle 2020 along a stowing direction 2023 until the stop paddle 2020 is disposed in the stowed position.

Figure 2D:
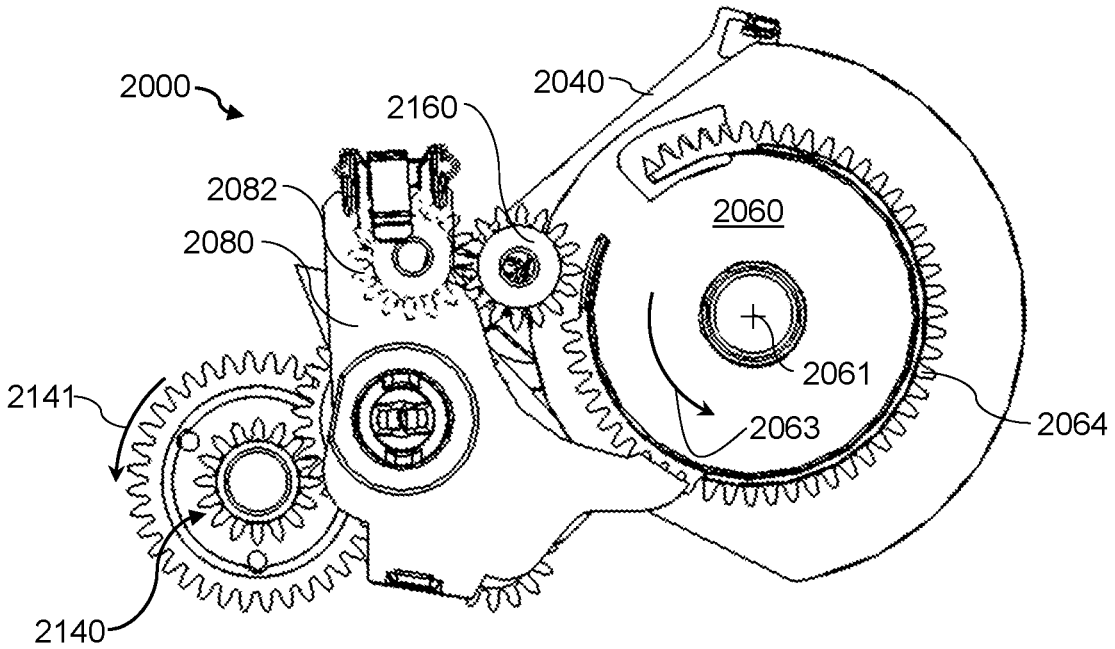
FIG. 2D is a side view of an example load stop.

Referring additionally to FIG. 2D, an outside side view of the example load stop 2000 is illustrated wherein the stop paddle 2020 is disposed in the stowed position. As illustrated, the swingarm 2080 may be disposed in the first position and may continue to transmit motion from the motive element to the cam gear 2060 in order to drive the cam gear 2060 in the first direction 2063. As described above, motion of the cam gear 2060 in the first direction 2063 may transition the stop paddle 2020 from the gathering position to the stowed position. In some implementations, the swingarm 2080 may include an upper drive wheel 2082 that may engage with the idler wheel 2160 when the swingarm 2080 is disposed in the first position, such that the idler wheel 2160 engages the upper drive wheel 2082 with the cam gear 2060 to drive the cam gear 2060 in the first direction 2063. In order to stop the stop paddle 2020 in the stowed position, the ring gear 2064 of the cam gear 2060 may be timed such that the ring gear 2064 may run out of an engagement feature, such as gear teeth, for example, for the swingarm 2080, or the idler wheel 2160, in some implementations, to engage with. Thus, even if the motive element were to continue driving the transmission in the first drive direction 2141, the cam gear 2060 may still stop rotating in the first direction when the stop paddle 2020 reaches the stowed position.

Figure 2E:
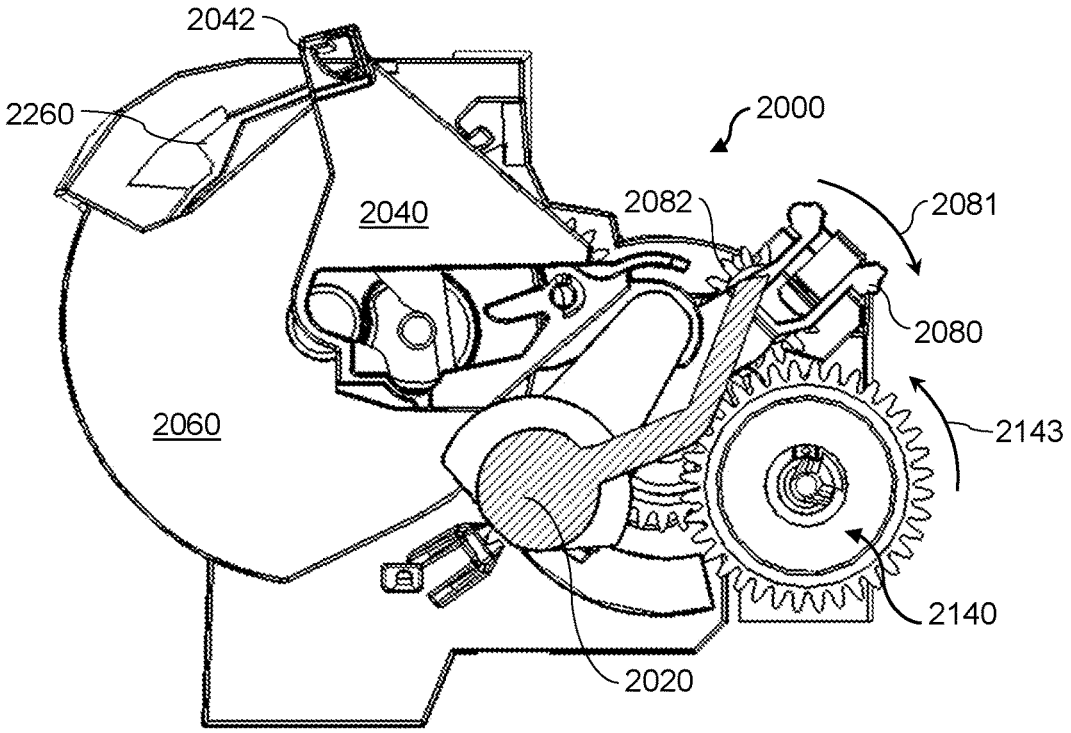
FIG. 2E is a side view of an example load stop.
Figure 2F:
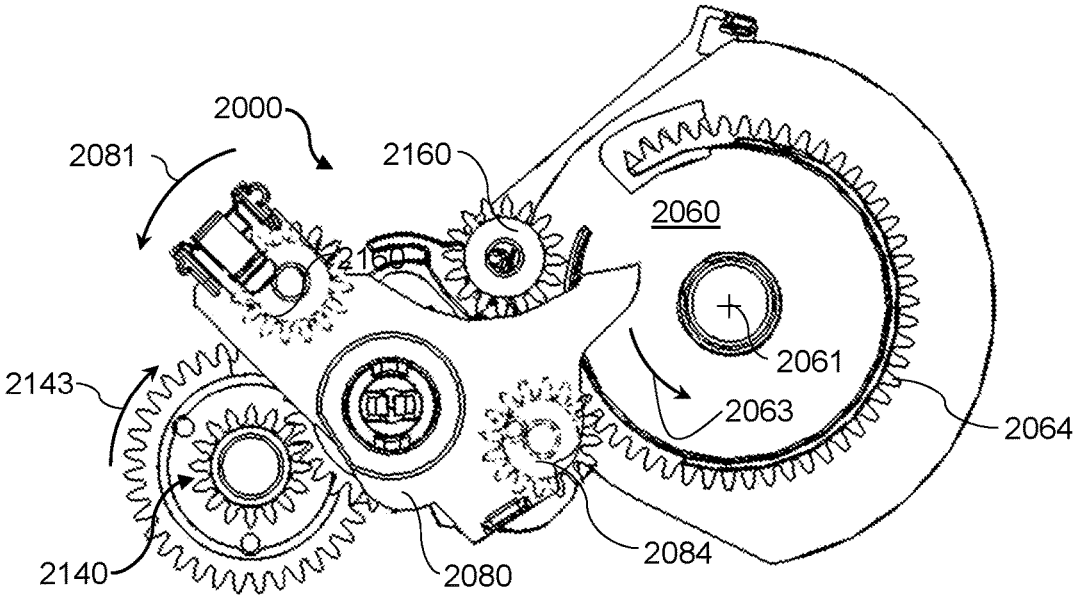
FIG. 2F is a side view of an example load stop.

Referring now to FIGS. 2E-2F, an inside and outside side view of the example load stop 2000 is illustrated, respectively, wherein the stop paddle 2020 is disposed in the stowed position, and the motive element changes drive direction. In some implementations, the motive element may change drive direction from driving the transmission 2140 in the first drive direction 2141, to driving the transmission in a second drive direction 2143. In some implementations, the drive element, in addition to driving the load stop 2000, may also drive other components or systems of the imaging device. Such other systems or components may cause, or otherwise have the drive element switch driving directions while the stop paddle 2020 is disposed in the stowed position. In such a situation, the swingarm 2080 may pivot along direction 2081 to a second position in order to continue to drive the cam gear 2060 in the first direction and transition the stop paddle 2020 from the stowed position, back to the locked position. The transmission 2140 being driven in the second drive direction 2143 may exert enough torque on the swingarm 2080 to cause the swingarm 2080 to pivot to the second position until a lower drive wheel 2084 of the swingarm 2080 is engaged with the cam gear 2060 and drives the cam gear 2060 in the first direction. While the swingarm 2080 is pivoting along direction 2081, the cam gear 2060 may be idle and not move until the swingarm 2080 reaches the second position, wherein the swingarm 2080 may then continue to drive the cam gear 2060 in the first direction. Thus, the swingarm 2080 may be capable of driving the cam gear 2060 in the first direction regardless of the drive direction of the motive element.

Figure 2G:
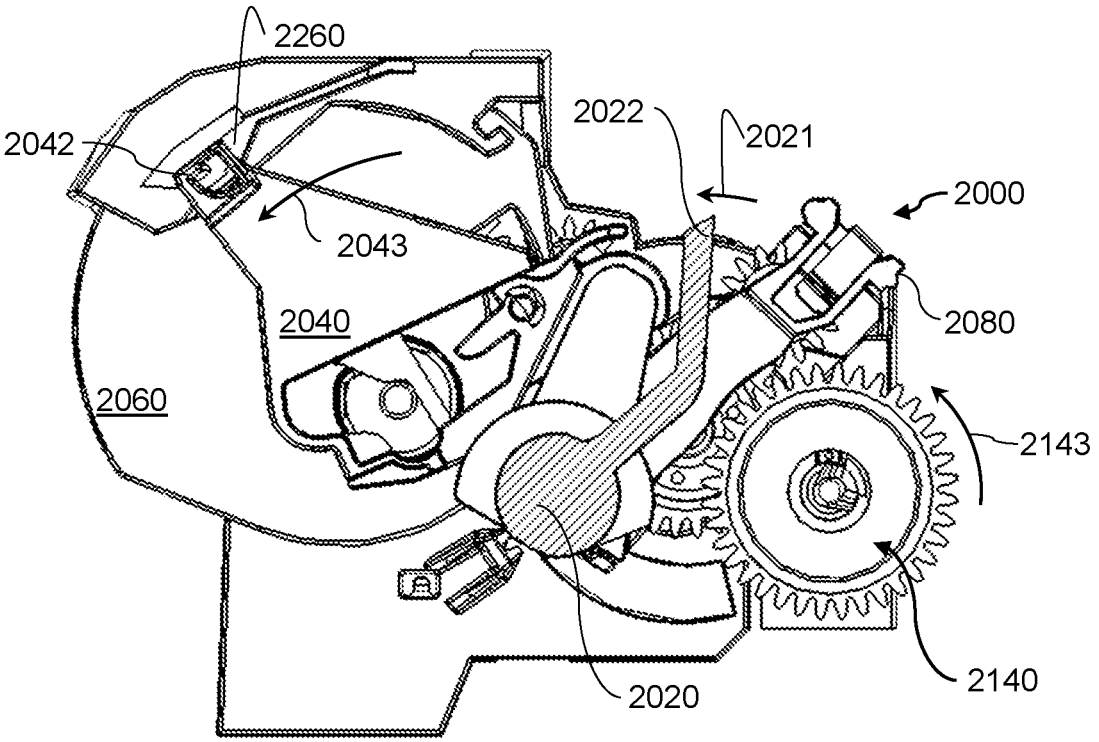
FIG. 2G is a side view of an example load stop.

Referring now to FIG. 2G, an inside side view of the example load stop 2000 is illustrated wherein the stop paddle 2020 has been transitioned from the stowed position back to the locked position. The swingarm 2080 may be disposed in the second position, thereby transmitting the motion of the transmission 2140 in the second drive direction 2143 to the cam gear 2060 through the lower drive wheel 2084 such that the cam gear 2060 is driven in the first direction 2063 so as to drive the paddle link 2040 to move or rotate the stop paddle 2020 along direction 2021 to the locked position. In transitioning the stop paddle 2020 back to the locked position, in some implementations, the cam gear 2060 may also transition the lock latch 2042 along example direction 2043 back into engagement with the complementary locking feature 2260. Once engaged with the locking feature 2260, the lock latch 2042 may prevent the stop paddle 2020 from being forcibly moved from the locked position, for example, in a direction towards the stowed position. In some implementations, once the stop paddle 2020 is back in the locked position, the motive element may, again, change drive direction such that the drive element is driving the transmission in the first drive direction 2141. This change in drive direction may provide enough torque to the swingarm 2080 to pivot the swingarm 2080 back to the first position, such that the upper drive wheel 2082 is able to drive the cam gear in the first direction 2063, through the idler wheel 2160, in some implementations. While the swingarm 2080 is transitioning back to the first position, the cam gear 2060 may be idle, in some implementations, until the upper drive wheel 2082, again, engages with the cam gear 2060. In some implementations, at this stage, the above functions may be repeated.

Figure 3A:
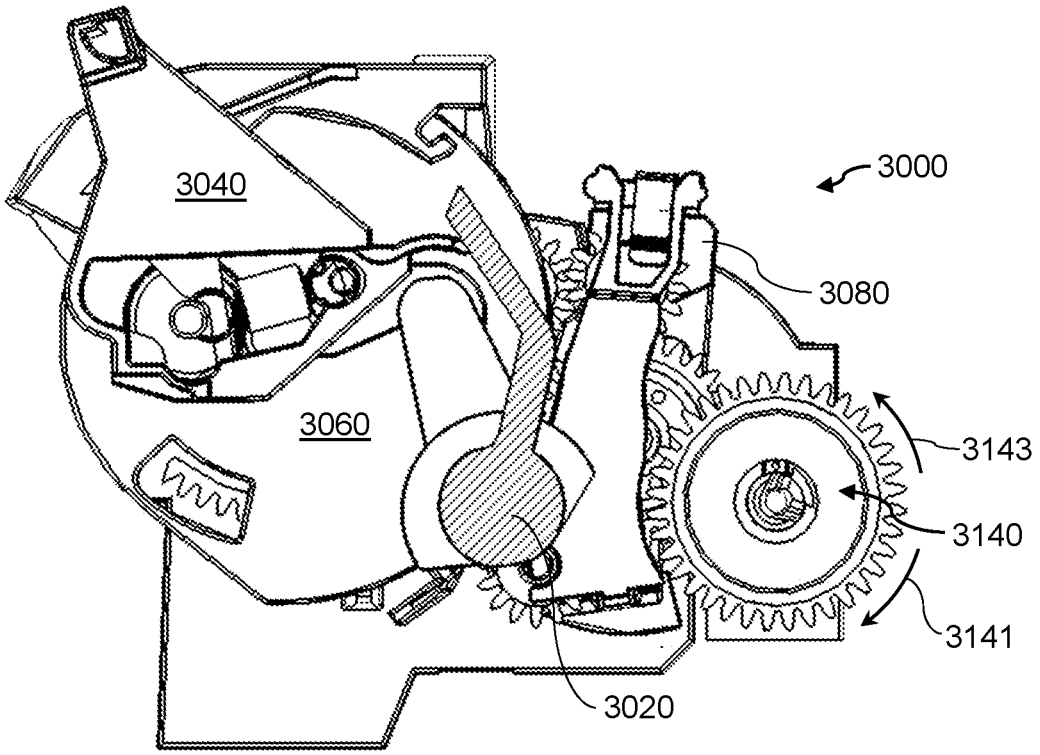
FIG. 3A is a side view of an example load stop.

Referring now to FIG. 3A, an inside side view of an example load stop 3000 is illustrated. Example load stop 3000 may be similar to example load stop 1000 or 2000. Further, the similarly named elements of example load stop 3000 may be similar in function and/or structure to the elements of example load stops 1000 or 2000, as they are described above. The example load stop 3000 may have a stop paddle 3020 that may be switchably disposed in a locked position, in a gathering position, and in a stowed position. FIG. 3A illustrates the stop paddle 3020 of the example load stop 3000 disposed in the gathering position. The stop paddle 3020, in some implementations, may have been rotated or transitioned from the locked position to the gathering position by a motive element driving a transmission 3140 in a first drive direction 3141. The stop paddle 3020 may have been driven by a paddle link 3040, which, in turn, may have been driven by a cam gear 3060, which, in turn, may have been driven in a first direction by a swingarm 3080. The swingarm 3080 may be pivotable between a first and second position. In some situations, the motive element may change driving directions such that the motive element drives the transmission in a second drive direction 3143. The drive element, in some implementations, may change drive direction while the stop paddle 3020 is in the gathering position, or otherwise in a position other than the stowed position.

Figure 3B:
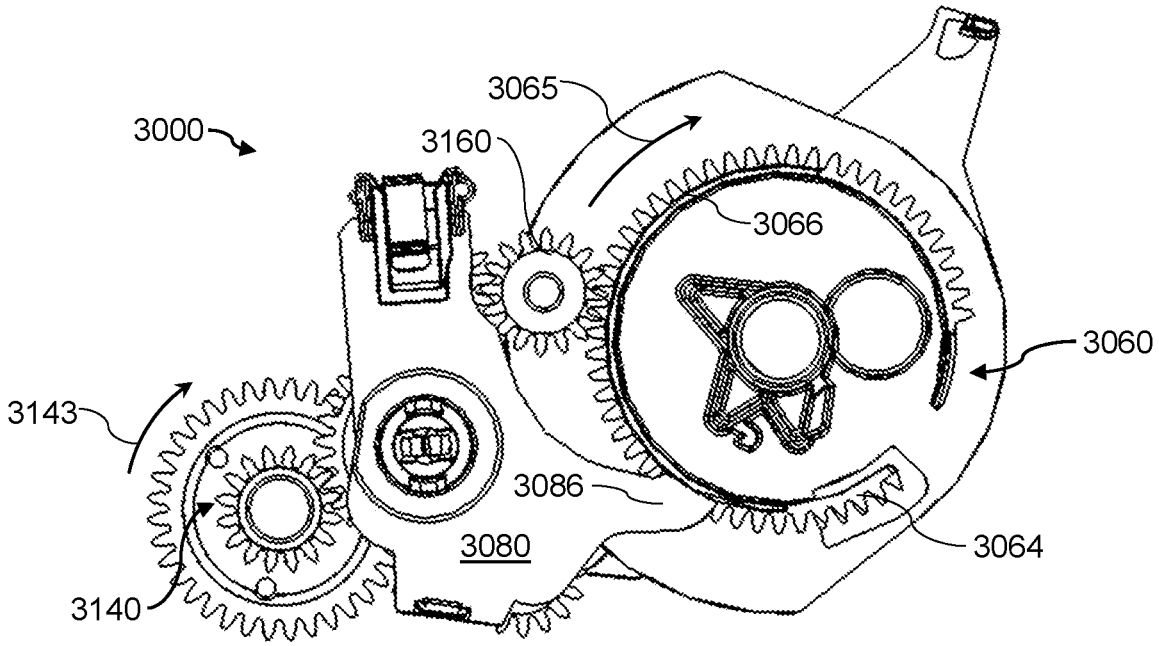
FIG. 3B is a side view of an example load stop.
Figure 3C:
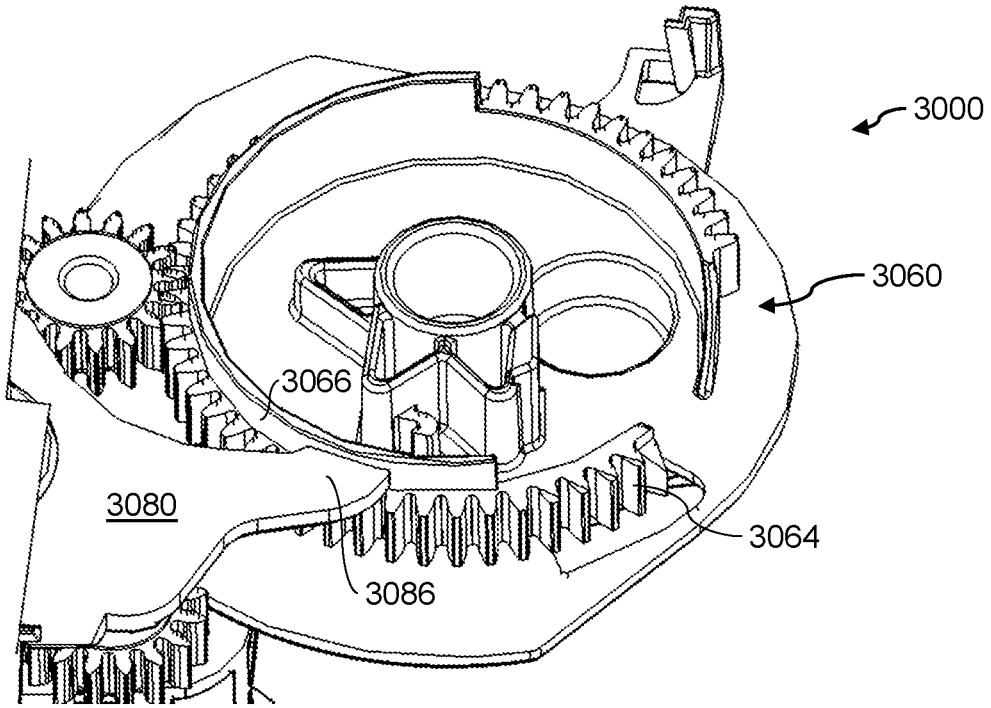
FIG. 3C is a perspective view of an example cam gear of an example load stop.

Referring additionally to FIG. 3B, an outside side view of the example load stop 3000 is illustrated, wherein the motive element has switched directions and started to drive the transmission 3140 in the second drive direction 3143. While the drive element, through the transmission 3140, may exert torque on the swingarm 3080 in the second drive direction 3143, the swingarm may be prevented from pivoting to the second position by the engagement of the swingarm 3080 with a guide wall 3066 of the cam gear 3060 while the cam gear 3060, and thus the stop paddle 3020 is in a position other than the stowed position. Referring additionally to FIG. 3C, a perspective view of the example cam gear 3060 of the load stop 3000 is illustrated, wherein the cam gear 3060, and thus the stop paddle 3020, is in the same position as illustrated in FIGS. 3A-3B. In some implementations, the swingarm 3080 may have a follower arm 3086 to engage with the guide wall 3066 of the cam gear 3060. The guide wall may extend from the cam gear 3060 to engage with the follower arm 3086 such that the follower arm 3086 may contact and slide along the length of the guide wall. In some implementations, the guide wall 3066 may extend from, and extend circumferentially with, the ring gear 3064 of the cam gear 3060. The guide wall 3066 may be timed, or, in other words, may extend circumferentially a sufficient length along the cam gear 3060, or the ring gear 3064 thereof, such that the follower arm 3086 is to engage with the guide wall 3066 only during a specific rotational position of the cam gear 3060. In some implementations, the follower arm is to engage with the guide wall 3066 while the cam gear 3060 drives the stop paddle 3020 through positions other than the stowed position. Therefore, while the stop paddle 3020 is disposed in the stowed position, and the cam gear 3060 is disposed in a corresponding position, the follower arm 3086 may not engage with the guide wall 3066, such that, if the drive element were to switch drive directions, the guide wall 3066 would not prevent the swingarm 3080 from pivoting to the second position.

In some implementations, when the drive element switches direction to drive the transmission in the second drive direction 3143, and the follower arm 3086 is engaged with the guide wall 3066, the swingarm 3080 may switch from driving the cam gear 3060 in the first direction to driving the cam gear 3060 in a second direction 3065. Driving the cam gear 3060 in the second direction 3065, opposite to the first direction, may reverse the corresponding motion of the paddle link 3040, and thus, the stop paddle 3020, rotating or transitioning the stop paddle 3020 from the gathering position, or another position, other than the stowed position in some implementations, back towards the locked position.

Figure 3D:
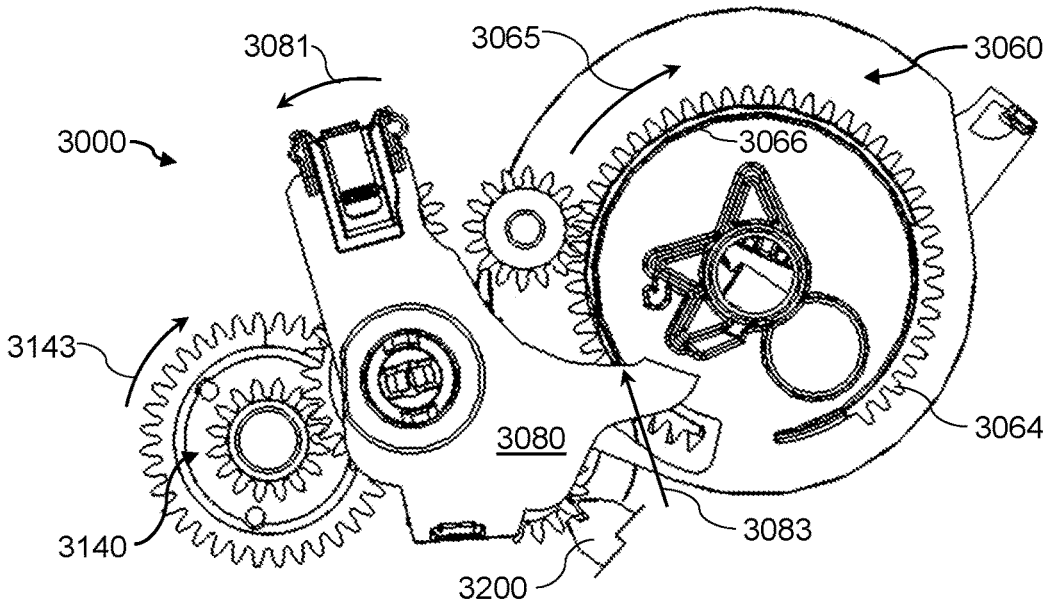
FIG. 3D is a side view of an example load stop.
Figure 3E:
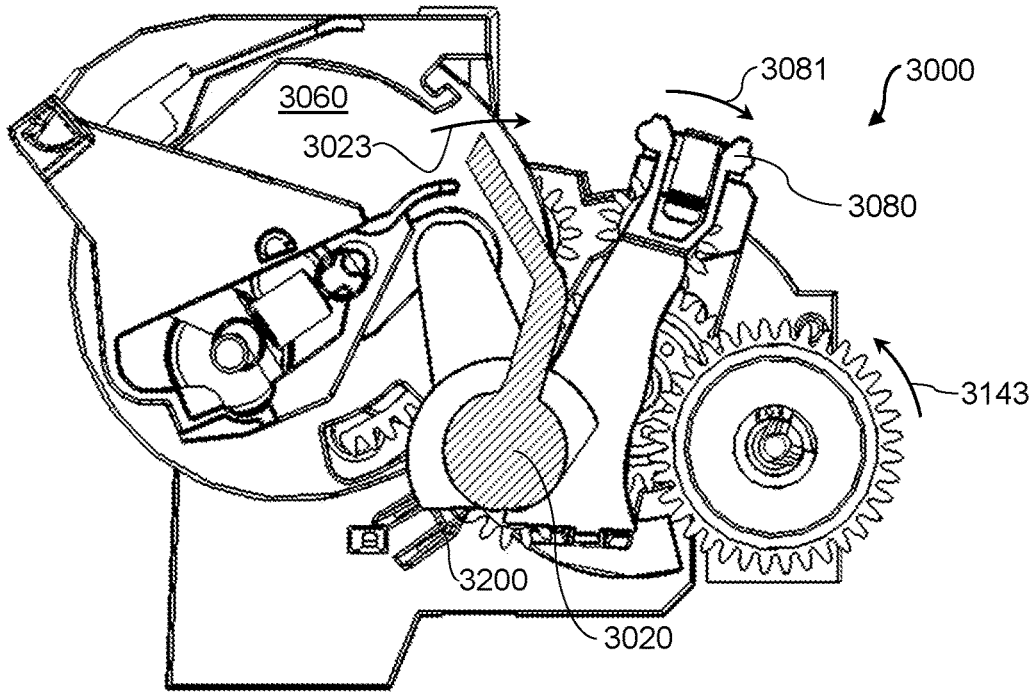
FIG. 3E is a side view of an example load stop.

Referring now to FIGS. 3D-3E, an outside side view and an inside side view, respectively, of the example load stop 3000 is illustrated, wherein the swingarm 3080 has driven the cam gear 3060 in the second direction 3065. In some implementations, the swingarm 3080 may continue to drive the cam gear 3060 in the second direction 3065, and thus the stop paddle 3020 back towards the locked position along direction 3023, until the follower arm 3086 reaches an end of the guide wall 3066. At such a point, the lack of continuing engagement between the follower arm 3086 and the guide wall 3066 may allow the swingarm 3080 to begin to, or partially pivot towards the second position, along a direction 3081, due to the transmission exerting torque on the swingarm 3080 in the second drive direction 3143. In such a situation, the follower arm 3086 may shift from engaging with the side of the guide wall 3066, to engaging with the end of the guide wall 3066, and exerting a force 3083 on the end of the guide wall 3066 such that the force 3083 continues to drive the cam gear 3060 in the second direction 3065. The farther that the cam gear 3060 is driven in the second direction, the farther that the swingarm 3080 may pivot to the second position, in some implementations. In further implementations, the swingarm 3080 may include a lower drive wheel to engage with a stationary set of guide teeth 3200. The lower drive wheel may be driven by the transmission 3140, in some implementations, and/or intermediary components, and may also engage with the stationary guide teeth 3200 in order to push the follower arm 3086 against the end of the guide wall 3066, thereby exerting force 3083. In some implementations, the stationary guide teeth 3200 may be stationary relative to the swingarm 3080, and/or the cam gear 3060.

Figure 3F:
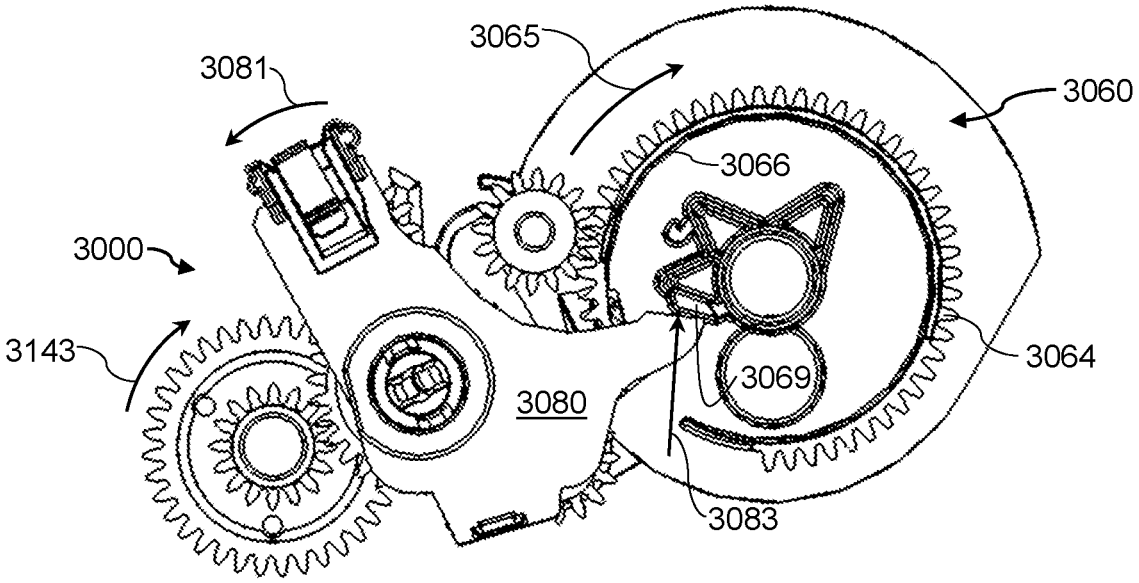
FIG. 3F is a side view of an example load stop.

Referring now to FIG. 3F, an outside side view of the example load stop 3000 is illustrated, wherein the cam gear 3060 has been driven farther in the second direction 3065. In some implementations, the cam gear 3060 has continued in the second direction 3065, and the swingarm 3080 has continued to pivot along direction 3081 towards the second position, such that the follower arm 3086 can no longer exert a force on the end of the guide wall 3066. In such a situation, the rotation of the swingarm 3080 and the cam gear 3060 may enable the follower arm 3086 to move inside the guide wall 3066 and to contact a drive tab 3069. Similar to the end of the guide wall, the follower arm 3086 may now exert a force 3083 on the drive tab 3069 such that the follower arm 3086 continues to drive the cam gear 3060 in the second direction 3065 as the swingarm 3080 continues to pivot along direction 3081 to the second position.

Figure 3G:
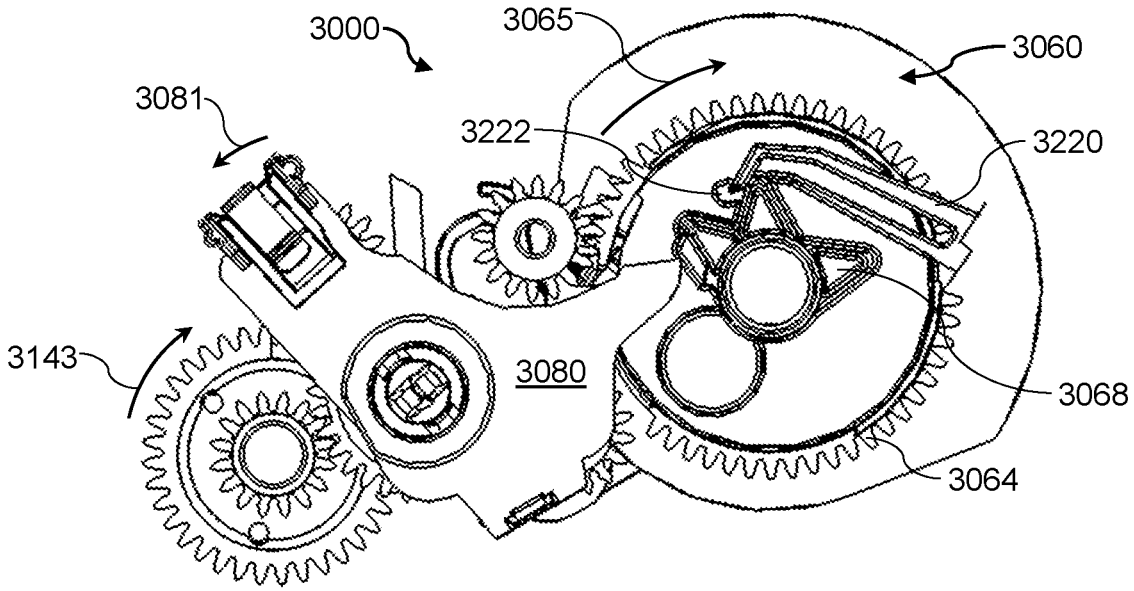
FIG. 3G is a side view of an example load stop.
Figure 3H:
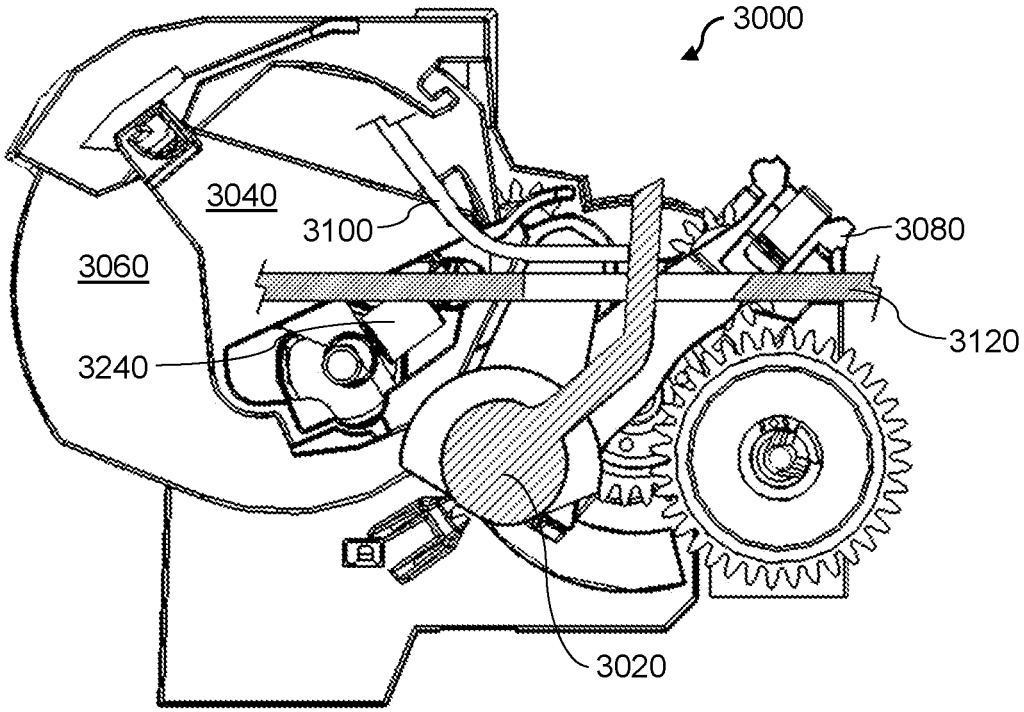
FIG. 3H is a side view of an example load stop.

Referring now to FIGS. 3G-3H, an outside side view and an inside side view of the example load stop 3000 is illustrated, wherein the cam gear 3060 has rotated along the second direction 3065 to completely move the stop paddle 3020 back to the locked position. The drive element has driven the transmission 3140 in the second drive direction 3143 to completely pivot the swingarm 3080 from the first position to the second position along direction 3081.

Throughout such a pivot motion, swingarm 3080 has driven the cam gear 3060 along the second direction, such that the cam gear 3060 has driven the paddle link 3040, which has completely transitioned the stop paddle 3020 from the gathering position, back to the locked position. In the locked position, the stop paddle 3020 now may protrude or extend through an aperture or opening in a separator wall 3120 so that the stop paddle partially reversibly extends into an input area of an imaging device and stops media 3100 from being inserted too far into a media path or into the input area.

In some implementations, the cam gear 3060 may include a detent lobe or lobes 3068 to engage with detent tabs 3220 of the imaging device. In some implementations, the detent tabs 3220 may be stationary relative to the cam gear 3060. The engagement of the detent lobes 3068 with the detent tabs 3220 may prevent the cam gear 3060 from accidentally moving out of position, in some implementations. A detent tab 3220 may engage with a detent lobe 3068, for example, to hold the cam gear 3060 in position while the stop paddle 3020 is in the locked position. In further implementations, the detent lobes 3068 may cause the cam gear 2060 to jump into engagement with the detent tabs 3220, thereby immediately removing some of the transmission components, such as gears, from engagement with complementary components that they may be transitioning out of engagement with. Therefore, the detent lobes 3068 engaging with the detent tabs 3220 may prevent gear teeth, or other engagement features from interfering with complementary teeth, or engagement features, of other components from which the gears may be disengaging. In other words, the detent lobes 3068 and the detent tabs 3220 may prevent gears from damaging each other as they disengage. The detent lobes 3220 may include a cradle 3222, in some implementations, to receive an end of a detent tab 3220 to prevent the cam gear 3060 from moving too far in the second direction 3065. Further, the cradle 3222 may prevent the stop paddle 3020 from being forced out of the locked position by media pushing on the stop paddle 3020. Additionally, in some implementations, the load stop 3000 may include a bias member 3240 disposed in between the paddle link 3040 and the cam gear 3060. The bias member 3240 may be a resilient component capable of elastic deformation, or returning to its original shape after experiencing a deformation. In some implementations, the bias member 3240 may be a tension spring, compression spring, torsion spring, or another type of spring. In further implementations, the bias member 3240 may enable the paddle link 3040 and the cam gear 3060 to resistively move relative to one another. In some implementations, this freedom of motion may allow the stop paddle 3020 to compress and organize stacks or amounts of media of differing thicknesses when transitioning from the locked position to the gathering position.

What is claimed is:

1. A device, comprising:

a stop paddle;

a paddle link to be a load stop and to move the stop paddle from a locked position, to a gathering position, and to a stowed position;

a swingarm engaged with a motive element; and a cam gear to engage the swingarm with the paddle link, the swingarm to transfer the motion of the motive element to the cam gear such that the cam gear is to move in a first direction, the cam gear to drive the paddle link to move the stop paddle from the locked position, to the gathering position, and to the stowed position when the motive element moves in a first drive direction, and the swingarm moves the cam gear in the first direction, and wherein the swingarm is to pivot to a second position to engage a lower drive wheel with the cam gear to further move the cam gear in the first direction when the motive element moves in a second drive direction.

2. The device of claim 1, wherein the cam gear is to further drive the paddle link to move the stop paddle from the stowed position back to the locked position when the cam gear moves in the first direction.

3. The device of claim 2, wherein the swingarm is to pivot to a first position to engage an upper drive wheel with the cam gear to move the cam gear in the first direction when the motive element moves in the first drive direction.

4. The device of claim 3, further comprising an idler wheel to engage the upper drive wheel with the cam gear when the swingarm is in the first position to move the cam gear in the first direction.

5. The device of claim 1, wherein the paddle link is to latch on to a locking feature of the load stop when the stop paddle is in the locked position, the paddle link to prevent the stop paddle from being moved out of the locked position when the paddle link is latched.

6. The device of claim 1, further comprising a plurality of stop paddles, the plurality of stop paddles disposed on a paddle shaft.

7. A load stop, comprising:

a stop paddle switchably disposed in a locked position, a gathering position, and a stowed position;

a paddle link to change the position of the stop paddle;

a cam gear to drive the paddle link to change the position of the stop paddle when the cam gear is driven in a first direction by a feed shaft;

an idler wheel engaged with the cam gear to drive the cam gear; and a swingarm to engage the feed shaft with the cam gear and to transfer the motion of a motive element to the cam gear such that the cam gear is to move in the first direction, the cam gear to drive the paddle link to move the stop paddle from the locked position, to the gathering position, and to the stowed position when the motive element moves in the first direction, and wherein the swingarm is to pivot to a second position to engage a lower drive wheel with the cam gear to further move the cam gear in the first direction when the motive element moves in a second drive direction.

8. The load stop of claim 7, wherein the cam gear comprises a ring gear, the idler wheel to engage with the ring gear to drive the cam gear.

9. The load stop of claim 7, wherein the swingarm engages with a guide wall of the cam gear to stay in the first position when the feed shaft switches from the first drive direction to the second drive direction while the stop paddle is in the gathering position, such that the swingarm drives the cam gear in a second direction.

10. The load stop of claim 9, wherein the swingarm is to transition from the first position towards the second position when the swingarm engages with an end of the guide wall, the swingarm to push on the end of the guide wall during the transition to drive the cam gear in the second direction.

11. The load stop of claim 10, wherein the swingarm is to push on a drive tab of the cam gear to continue to drive the cam gear in the second direction until the swingarm completes the transition to the second position.

12. The load stop of claim 11, wherein the paddle link moves the stop paddle to the locked position when the cam gear moves in the second direction.

13. The load stop of claim 7, further comprising a detent tab to engage with a detent lobe of the cam gear to hold the cam gear in position when the stop paddle is in the locked position.

14. An imaging device, comprising:

a feed shaft engaged with a motive element to drive the feed shaft in a first drive direction and a second drive direction; and a load stop, comprising:

a stop paddle to reversibly extend into a load area of the imaging device;

a paddle link to drive the stop paddle from a locked position to a gathering position, to a stowed position when the feed shaft moves in a first drive direction;

a transmission to engage with the feed shaft, the transmission comprising a swingarm; and a cam gear to engage the swingarm with the paddle link, the swingarm to transfer the motion of the motive element to the cam gear such that the cam gear is to move in the first direction, the cam gear to drive the paddle link to move the stop paddle from the locked position, to the gathering position, and to the stowed position when the motive element moves in the first direction, and wherein the swingarm is to pivot to a second position to engage a lower drive wheel with the cam gear to further move the cam gear in the first direction when the motive element moves in a second drive direction.

* * * * *